US009770098B1

(12) United States Patent
Holbrook

(10) Patent No.: US 9,770,098 B1
(45) Date of Patent: Sep. 26, 2017

(54) TABLE LEG CONNECTION

(71) Applicant: Prospect Furniture LLC, Pasadena, CA (US)

(72) Inventor: Richard Holbrook, Pasadena, CA (US)

(73) Assignee: Prospect Furniture LLC, Pasadena, CA (US)

( * ) Notice: Subject to any disclaimer, the term of this patent is extended or adjusted under 35 U.S.C. 154(b) by 0 days.

(21) Appl. No.: 15/375,132

(22) Filed: Dec. 11, 2016

(51) Int. Cl.
*F16M 11/00* (2006.01)
*A47B 13/02* (2006.01)
*F16B 12/44* (2006.01)

(52) U.S. Cl.
CPC ..... *A47B 13/021* (2013.01); *F16B 12/44* (2013.01)

(58) Field of Classification Search
CPC .. F16B 12/44; A47B 13/023; A47B 2013/022
USPC ..... 248/188, 188.1, 188.7
See application file for complete search history.

(56) References Cited

U.S. PATENT DOCUMENTS 2,853,348 A 9/1958 Adler
3,078,063 A * 2/1963 Frankl ..... A47B 13/023 108/150
3,329,383 A 7/1967 Pilliod
3,443,782 A * 5/1969 Fields ..... A47B 13/04 248/188.7
4,064,815 A 12/1977 Baum
4,793,579 A 12/1988 Finkelstein
4,821,986 A * 4/1989 White ..... A47B 13/023 248/188.7
5,056,746 A 10/1991 Parsons
5,082,222 A * 1/1992 Hsu ..... F16M 11/242 248/170
5,102,079 A * 4/1992 Lee ..... F16M 11/16 248/166
5,232,303 A 8/1993 Rubner
(Continued)

OTHER PUBLICATIONS

Altra 9326096 Assembly Instructions, Aug. 18, 2011 (15 pages).
Part No. A176428A Assembly Instructions, Jul. 1, 2015 (10 pages).

*Primary Examiner* — Steven Marsh
(74) *Attorney, Agent, or Firm* — Todd R. Miller

(57) ABSTRACT

A novel table leg connection and method of assembly are disclosed. The connection may comprise a stand having a hole, a leg including a pin extending away from one end of the leg wherein the pin is configured to fit within the stand hole, and a locking bracket having prongs configured to engage the pin, wherein the stand has an interior wall having grooves configured to engage the locking bracket. The locking bracket may include a fastening arm disposed opposite the prongs and extending substantially orthogonally away from the locking bracket. The pin may have a slot configured to engage the prongs of the locking bracket. The method of assembly may comprise inserting a pin of a leg into a hole of a stand, sliding a locking bracket having prongs through grooves formed in the interior wall of the stand, and pushing the locking bracket toward the pin until the prongs are frictionally engaged by the pin. The disclosed inventions advantageously permit a user-friendly connection between the legs and the stand of the table that promotes easy assembly. The disclosed inventions also allow for an efficient means of connecting a leg to a table stand to form a stable attachment that is sturdy and long lasting.

18 Claims, 6 Drawing Sheets

(56) References Cited

U.S. PATENT DOCUMENTS

| | | | | |
|---|---|---|---|---|
| 5,437,425 | A * | 8/1995 | Hou | A47C 7/004 248/166 |
| 5,934,630 | A | 8/1999 | Williams | |
| 7,703,728 | B2 * | 4/2010 | Petrick | A47B 81/064 248/188.1 |
| 8,091,489 | B2 | 1/2012 | Karrasch | |
| 8,322,787 | B2 | 12/2012 | Smith | |
| 8,904,623 | B2 | 12/2014 | Stanford | |

* cited by examiner

TABLE LEG CONNECTION

BACKGROUND

The present disclosure relates generally to table legs and particularly to the connection between a leg and a table stand.

The assembly of an item such as a bookshelf, toy, or table often leads to a sense of frustration. Parts mysteriously disappear. The so-called instruction manual is incomplete or otherwise indecipherable. The necessary tools are not provided or too many of them are needed at once using contorted hands in tight spaces. Moreover, assuming the item is eventually assembled and in the manner prescribed, the assembled item may be inadequate in terms of construction. For example, due to design flaws or the like, such as when a nut is tightened against a curved surface, the assembled item may be unstable at the onset. Or the assembled item may fail over time due to myriad reasons.

FIG. 1 illustrates pertinent aspects of assembling a conventional table 10 and particularly connecting a leg 16 and a table stand 14. The stand 14 includes a support 12 with holes for mounting a table top 34 at the top of the stand 14. At the bottom end of the stand 14, holes also exist for mounting four legs 16 (only one of which is shown) to the stand 14. Because the stand 14 itself has a circular shape, merely mounting the leg 16 to the stand 14 with a bolt 20 and nut 22 may lead to early failure of the table when in use. To increase chances of durability, a spacer 18 is used. The spacer 18 is configured to fit radially against the inside of the stand 14 with a flat side facing the center of the stand 14. In this manner, when the bolt 20 is fit through hole 24 in leg 16, through hole 26 in stand 14, through hole 28 in spacer 18, and then through the nut 22, the back of the nut 22 lies flush against the flat side of the spacer 18. To complete assembly of this aspect of the table, one then must fit a first wrench 30 into the space provided in the leg 16 to try to torque bolt 20 in one direction or hold bolt 20 still. At the same time, one also has to use another wrench 32 to torque nut 22 in the opposite direction or hold nut 22 still as needed.

Accordingly, an efficient means of connecting a leg to a table stand to form a stable attachment that is sturdy and long lasting is therefore desired.

SUMMARY

One exemplary embodiment of the disclosed subject matter is a novel table leg connection comprising a stand, a leg including a pin, and a locking bracket having prongs configured to engage the pin after it is inserted into a hole in the stand. The interior wall of the stand preferably has grooves configured to engage the locking bracket. The locking bracket also preferably includes a fastening arm disposed opposite the prongs. The fastening arm extends substantially orthogonally away from the locking bracket. The pin preferably has a slot configured to engage the prongs of the locking bracket.

Another exemplary embodiment of the disclosed subject matter is a method comprising inserting a pin of a leg into a hole of a stand, sliding a locking bracket having prongs through grooves formed in the interior wall of the stand, and pushing the locking bracket upward toward the pin until the prongs are frictionally engaged by the pin. Both the fastening arm and leg may each include a hole, further comprising inserting a screw through the fastening arm hole and through the leg hole, and rotating the screw until tight for an even more stable and sturdy connection between the table leg and stand.

BRIEF DESCRIPTION OF THE DRAWINGS

Some non-limiting exemplary embodiments of the disclosed subject matter are illustrated in the following drawings. Identical or duplicate or equivalent or similar structures, elements, or parts that appear in one or more drawings are generally labeled with the same reference numeral, optionally with an additional letter or letters to distinguish between similar objects or variants of objects, and may not be repeatedly labeled and/or described. Dimensions of components and features shown in the figures are chosen for convenience or clarity of presentation. For convenience or clarity, some elements or structures are not shown or shown only partially and/or with different perspective or from different point of views.

DETAILED DESCRIPTION

A general problem in the field of tables is the overall difficultly of assembly. A general solution is a user-friendly connection between the legs and the stand of the table that promotes easy assembly.

A technical problem in the field of table leg connections is the lack of sturdy construction and durability of the legs once assembled to the stand. A technical solution implementing the spirit of the disclosed inventions is a grooved stand interior for frictionally engaging a locking bracket that frictionally engages a pin protruding laterally from a leg. The locking bracket preferably includes a fastening arm that further holds the bracket in place against the leg by a single screw easily accessible during assembly.

Potential benefits of the general and technical solutions provided by the disclosed subject matter include those identified above plus the added bonus of needing fewer tools for assembly compared to conventional tables. Similarly, the disclosed inventions may advantageously be quickly disassembled and reassembled as necessary without any loss of strength of the overall construction.

A general non-limiting overview of practicing the present disclosure is presented below. The overview outlines exemplary practice of embodiments of the present disclosure, providing a constructive basis for variant and/or alternative and/or divergent embodiments, some of which are subsequently described.

Figure 1:
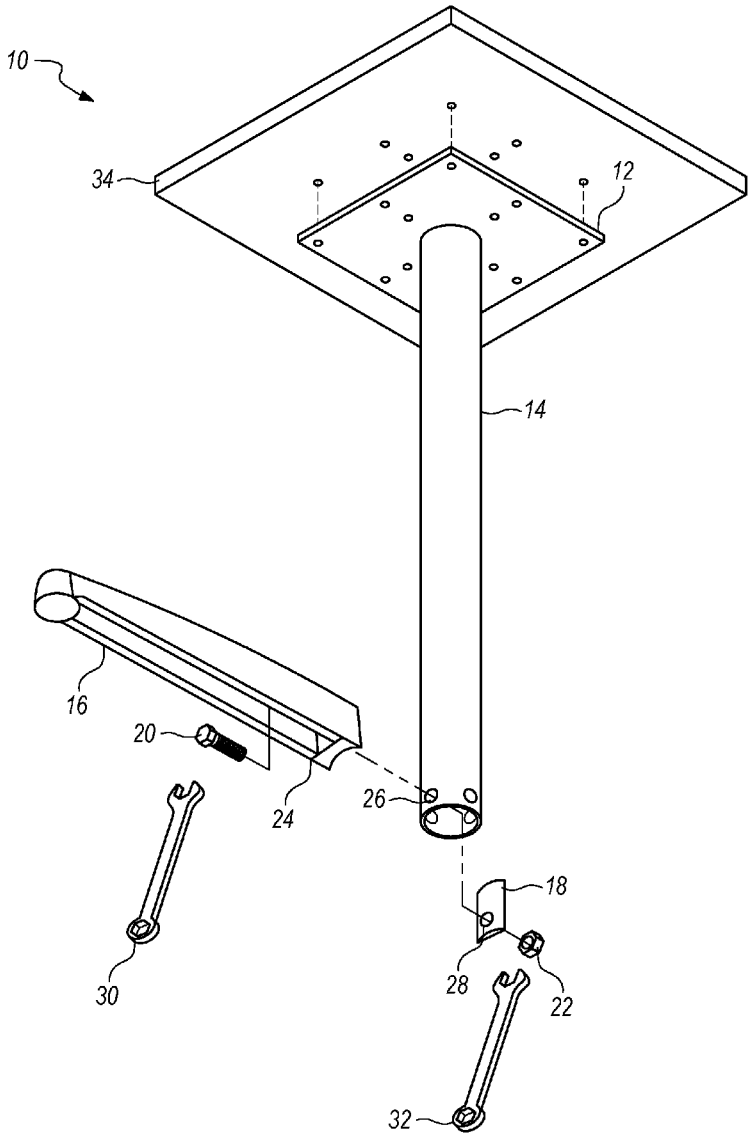
FIG. 1 (Prior Art)
FIG. 1 is an exploded view of pertinent aspects of a conventional table assembly.
Figure 2:
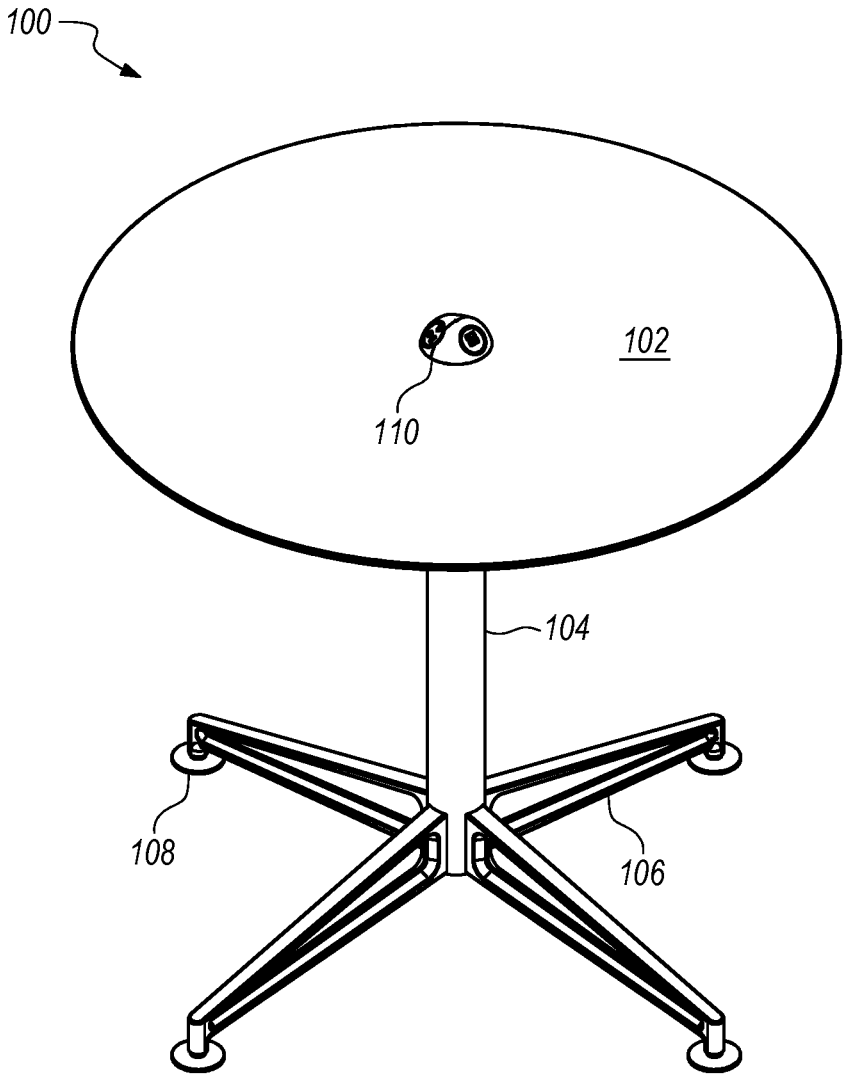
FIG. 2 is a perspective view of an exemplary table utilizing an embodiment of the inventions disclosed herein.
Figure 3:
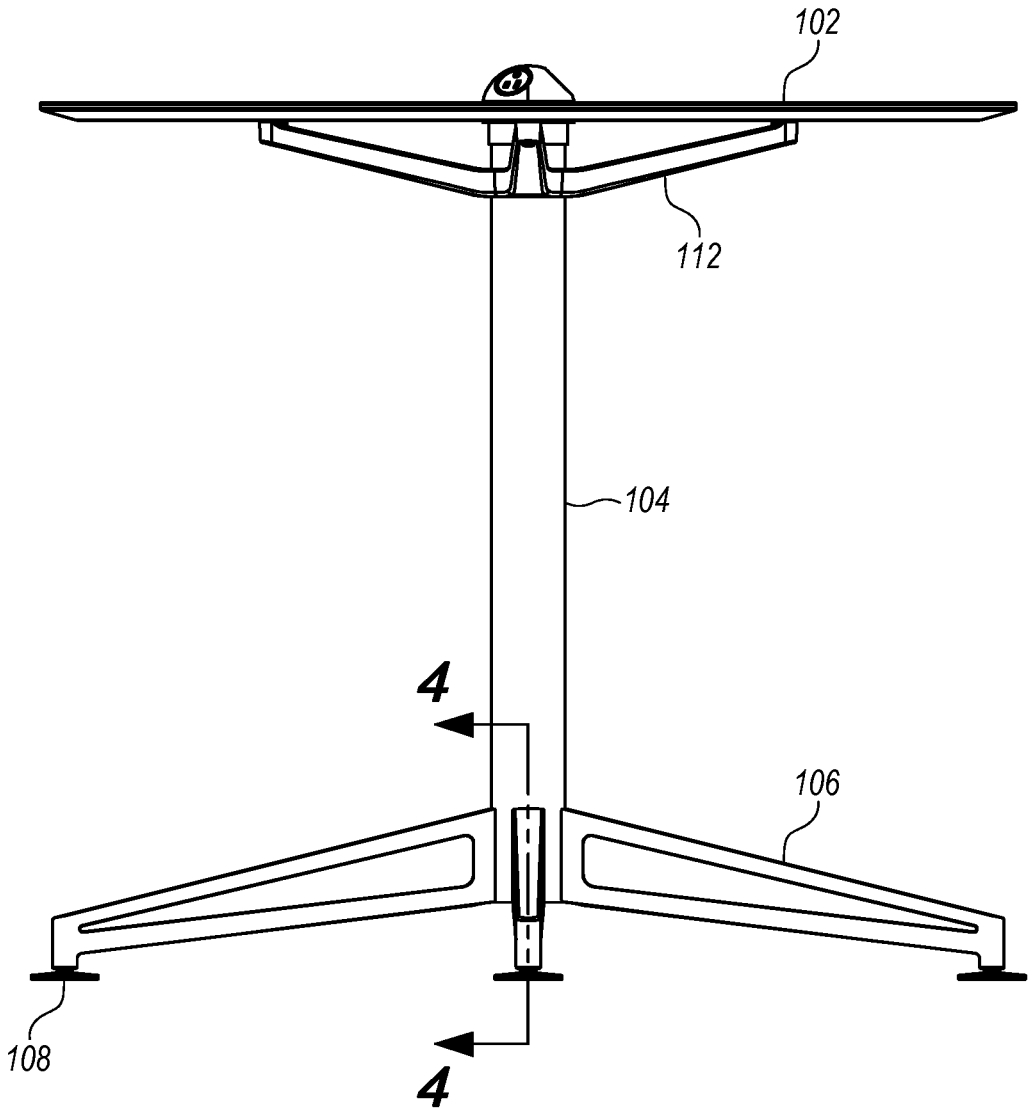
FIG. 3 is a side view of the table shown in FIG. 2.

FIGS. 2 and 3 illustrate an exemplary table 100 utilizing an embodiment of the inventions disclosed herein. The table 100 comprises a top 102, stand 104, and legs 106. Each leg 106 may include a leveler 108 to ensure the assembled table 100 is level. The top 102 may have an outlet 110 or the like disposed thereon for plugging in a laptop or other electrical item. The top 102 may be supported by a top brace 112 associated with the stand 104.

Figure 4:
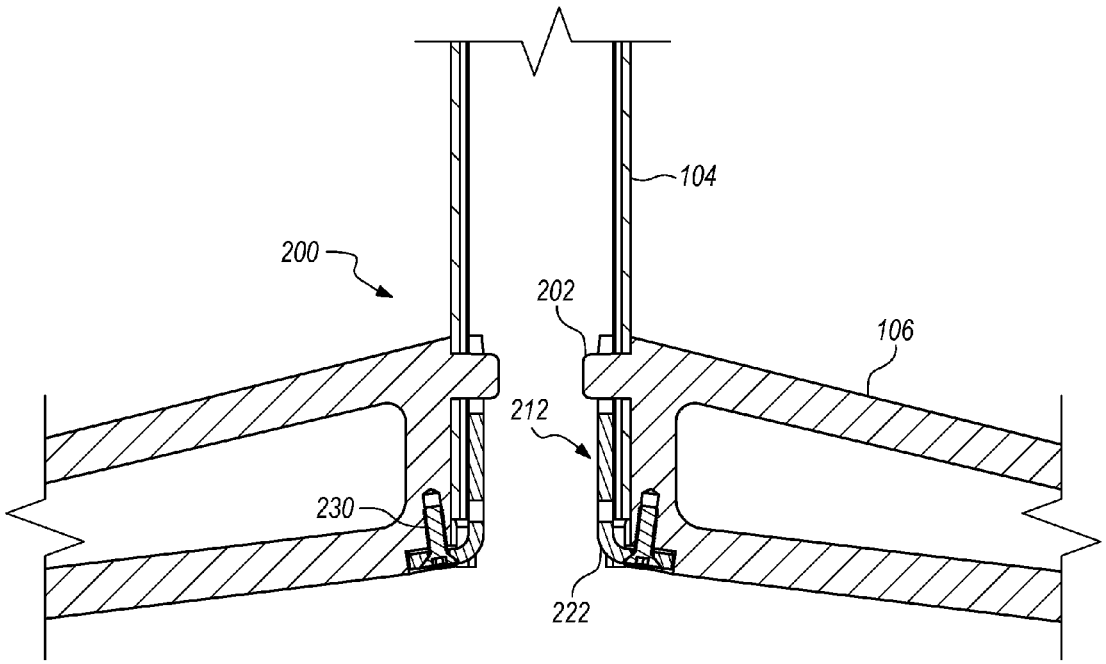
FIG. 4 is a cut-away view along line 4-4 in FIG. 3 illustrating a table leg connection according to an embodiment of the inventions disclosed herein.
Figure 5:
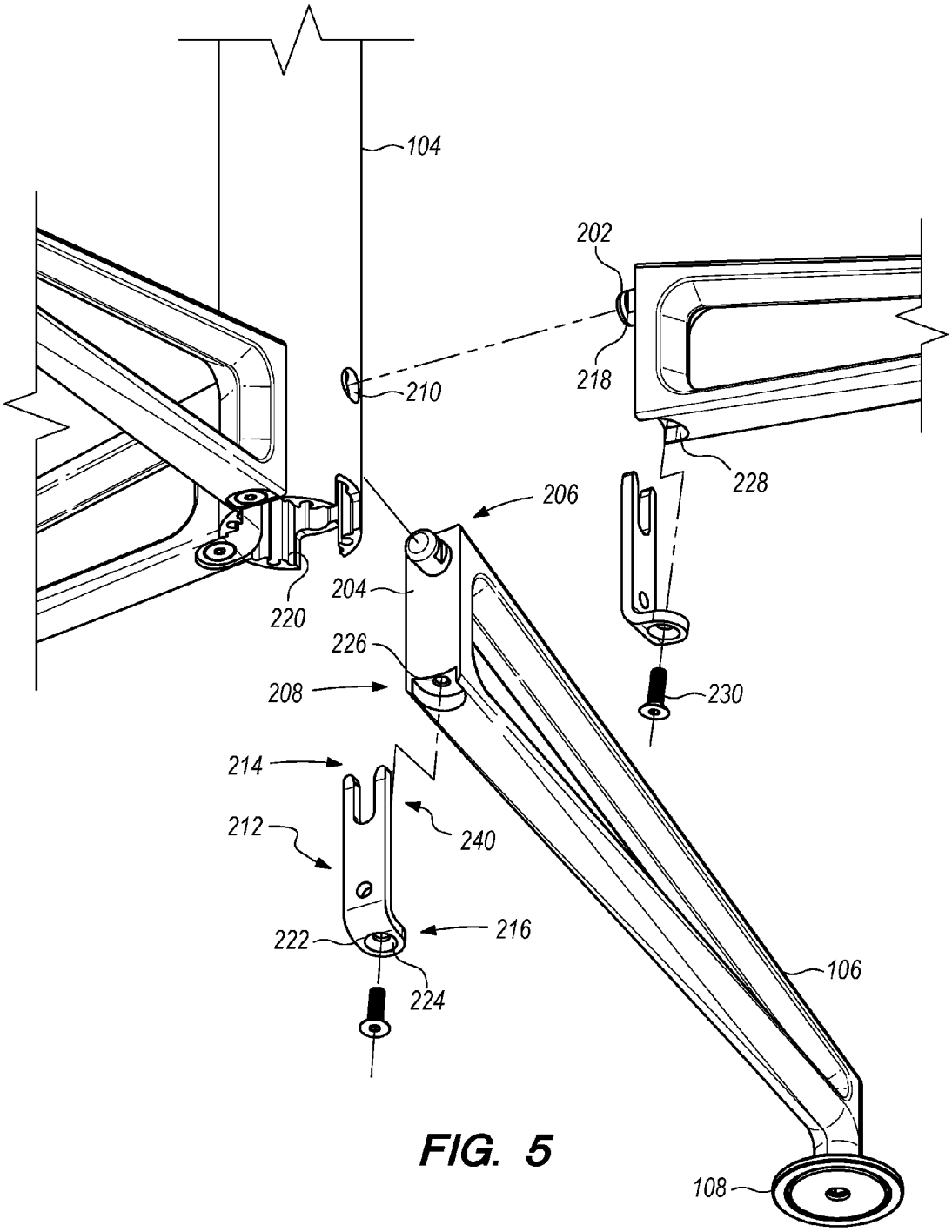
FIG. 5 is an exploded, perspective view of the table leg connection shown in FIG. 4.

FIG. 4 is a cut-away view taken along line 4-4 in FIG. 3 illustrating an embodiment of the novel table leg connection 200. FIG. 5 is an exploded, perspective view of the table leg connection 200 shown in FIG. 4.

Turning in detail to FIGS. 4 and 5, the table leg connection 200 includes a pin 202 disposed about the top 206 of leg 106. The pin 202 is located at the end opposite the leveler 108 of leg 106. The pin 202 extends along the axis of leg 106 and particularly away from an inner leg wall 204. This wall 204 is curved to fit against the outside of the circular stand 104. The pin 202 is configured to fit within a hole 210 in the stand 104 once the leg 106 is abutted against the stand 104 as part of the assembly process.

The interior wall of the stand 104 is grooved. Grooves 220 are configured to engage a locking bracket 212 having a top 214 and a bottom 216. The top 214 preferably includes prongs 240. The prongs 240 are configured to engage the pin 202 once inserted through hole 210 of stand 104. The locking bracket 212 preferably includes a fastening arm 222 disposed orthogonally from the bottom 216 of the bracket 212. The fastening arm 222 may include a hole 224 through which a screw 230 or the like may be inserted. A corresponding hole 226 is disposed at the bottom 208 of leg 106 opposite the pin 202. To keep the fastening arm 222 flush against the bottom 208 of leg 106, the leg 106 may include a cutout 228.

As seen best in FIG. 5, pin 202 may include a slot 218 for engaging prongs 240 of locking bracket 212. The slot 218 may be angled toward the interior wall of stand 104 in the direction of leg 106. In this manner, when the prongs 240 are inserted through slot 218, the prongs 240 are biased toward the inner wall of the stand 104 to make the connection between each leg 106 and stand 104 even more stable and sturdy.

Figure 6:
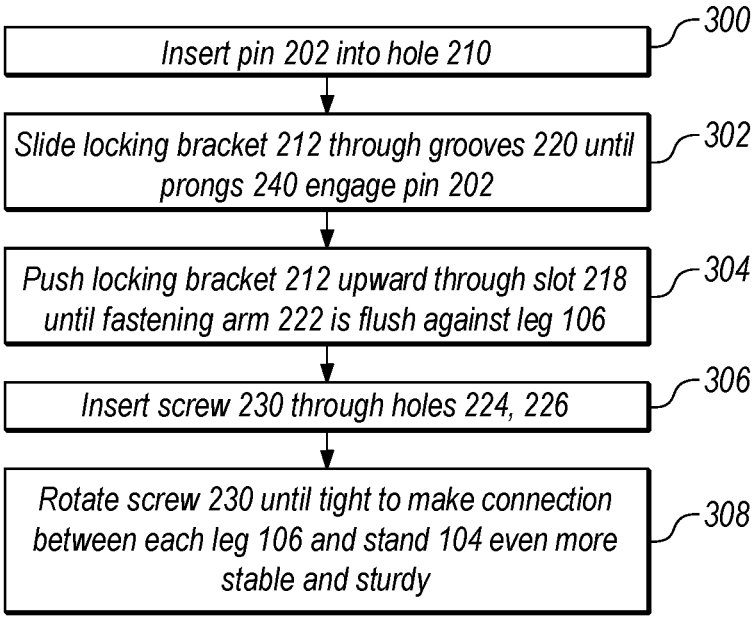
FIG. 6 is a flowchart showing the ease of assembly of the novel table leg connection disclosed herein.

In light of the above, the easy assembly of the disclosed table leg connection 200 may be seen in the flowchart of FIG. 6. The initial step 300 includes inserting pin 202 into hole 210 of stand 104. Next, step 302 illustrates how one must slide locking bracket 212 through grooves 220 until the prongs 240 engage the pin 202. Then push the locking bracket 212 upward through slot 218 of pin 202 until the fastening arm 222 is flush against the bottom 208 of leg 106 and thereby seated within cutout 228 of leg 106, as seen in step 304. The next step, step 306, involves inserting the screw 230 through the hole 224 of fastening arm 222 and then through the hole 226 of leg 106. The final step 308 involves rotating screw 230 until tight with the threads (not shown) inside of leg 106. These steps are repeated as needed for connecting the remaining legs 106 to the stand 104.

While certain embodiments have been described, the embodiments have been presented by way of example only and are not intended to limit the scope of the inventions. Indeed, the novel table leg connection described herein may be embodied in a variety of other forms. Furthermore, various omissions, substitutions, and changes in the form of the disclosed elements may be made without departing from the spirit of the inventions. The accompanying claims and their equivalents are intended to cover such forms or modifications as would fall within the scope and spirit of the inventions.

The invention claimed is:

1. A table leg connection comprising:

a stand having a hole;

a leg including a pin extending away from one end of the leg, the pin configured to fit within the stand hole;

a locking bracket having prongs at one end, the prongs configured to engage the pin;

wherein the stand has an interior wall having grooves configured to engage the locking bracket; and wherein the locking bracket includes a fastening arm disposed opposite the prongs.

2. The table leg connection of claim 1, wherein the fastening arm extends substantially orthogonally away from the locking bracket.

3. The table leg connection of claim 1, wherein the pin has a slot configured to engage the prongs of the locking bracket.

4. The table leg connection of claim 3, wherein the slot is angled toward the interior wall of the stand once inserted into the stand hole.

5. The table leg connection of claim 1, further comprising a leveler disposed about the end of the leg opposite the pin.

6. The table leg connection of claim 1, wherein the fastening arm includes a hole, and wherein the leg includes a cutout disposed on a bottom wall of the leg opposite the pin.

7. The table leg connection of claim 6, wherein the leg includes a hole disposed centrally within the cutout.

8. The table leg connection of claim 7, further comprising a screw, and wherein the fastening arm hole and the leg hole are configured to receive the screw.

9. The table leg connection of claim 6, wherein the leg cutout is configured to receive the fastening arm.

10. A method of connecting a table leg to a stand, the method comprising:

inserting a pin of a leg into a hole of a stand;

sliding a locking bracket having prongs through grooves formed in the interior wall of the stand; and pushing the locking bracket toward the pin until the prongs are frictionally engaged by the pin; and wherein the locking bracket further includes a fastening arm, and wherein the locking bracket is pushed until the prongs are frictionally engaged by the pin and until the fastening arm is seated against the leg.

11. The method of claim 10, wherein the fastening arm includes a hole, and wherein the leg includes a hole, and further comprising inserting a screw through the fastening arm hole and through the leg hole, and rotating the screw until tight.

12. The method of claim 10, wherein the fastening arm extends substantially orthogonally away from the locking bracket.

13. The method of claim 10, wherein the pin has a slot configured to engage the prongs of the locking bracket.

14. The method of claim 13, wherein the slot is angled toward the interior wall of the stand once inserted into the stand hole.

15. The method of claim 10, further comprising a leveler disposed about the end of the leg opposite the pin.

16. The method of claim 11, wherein the leg includes a cutout disposed on a bottom wall of the leg opposite the pin, wherein the cutout is configured to receive the fastening arm.

17. A table leg connection comprising:

a stand having a hole;

a leg including a pin extending away from one end of the leg, the pin configured to fit within the stand hole;

a locking bracket having prongs at one end, the prongs configured to engage the pin;

wherein the stand has an interior wall having grooves configured to engage the locking bracket; and wherein the pin has a slot configured to engage the prongs of the locking bracket.

18. The table leg connection of claim 17, wherein the locking bracket includes a fastening arm disposed opposite the prongs.

* * * * *